US005350468A

United States Patent [19]

Masumoto et al.

[11] Patent Number: 5,350,468

[45] Date of Patent: Sep. 27, 1994

[54] PROCESS FOR PRODUCING AMORPHOUS ALLOY MATERIALS HAVING HIGH TOUGHNESS AND HIGH STRENGTH

[75] Inventors: Tsuyoshi Masumoto, 3-8-22, Kamisugi, Aoba-ku; Akihisa Inoue, 11-806, Kawauchijutaku, Mubanchi, Kawauchi, Aoba-ku, both of Sendai-shi, Miyagi, Japan

[73] Assignees: Tsuyoshi Masumoto; Akihisa Inoue, both of Miyagi; Yoshida Kogyo K.K., Tokyo, all of Japan

[21] Appl. No.: 939,210

[22] Filed: Sep. 2, 1992

[30] Foreign Application Priority Data

Sep. 6, 1991 [JP] Japan ..... 3-227184

[51] Int. Cl.[5] ..... C22F 1/00

[52] U.S. Cl. ..... 148/561; 148/666; 148/669; 148/688; 148/403; 148/420; 148/421; 148/437; 148/438

[58] Field of Search ..... 148/561, 666, 668, 688, 148/403, 420, 421, 437, 438, 669; 420/402, 902

[56] References Cited

U.S. PATENT DOCUMENTS 5,053,085 10/1991 Masumoto et al. ..... 148/403

5,055,144 10/1991 Fish et al. ..... 148/403

FOREIGN PATENT DOCUMENTS 0494688A 7/1992 European Pat. Off. ..... 148/561

*Primary Examiner*—Richard O. Dean

*Assistant Examiner*—Robert R. Koehler

*Attorney, Agent, or Firm*—Flynn, Thiel, Boutell & Tanis

[57] ABSTRACT

A process for producing amorphous alloy materials having high toughness and high strength from various alloy powders, thin ribbons or bulk materials consisting of an amorphous phase by heating them to a temperature at which intermetallic compounds or other compounds are not produced. During this heating, fine crystal grains consisting of a supersaturated solid solution made of a main alloying element and additive elements and having a mean grain diameter of 5 nm to 500 nm are precipitated and uniformly dispersed in a volume percentage of 5 to 50% throughout an amorphous matrix. In the process, when deformation, pressing or other working is simultaneously conducted with the heating, consolidation or combining of the resultant alloy materials can also be effected in the same production procedure. The amorphous alloy used in the production process preferably comprises Al, Mg or Ti as a main element and, as additive elements, rare earth elements and/or other elements.

10 Claims, 2 Drawing Sheets

PROCESS FOR PRODUCING AMORPHOUS ALLOY MATERIALS HAVING HIGH TOUGHNESS AND HIGH STRENGTH

BACKGROUND Of THE INVENTION

1. Field of the Invention

The present invention relates to a process for producing amorphous alloy materials having high mechanical strength and high toughness.

2. Description of the Prior Art

The present inventors have already discovered aluminum-based alloys and Mg-based alloys having excellent strength, corrosion resistance, etc., as described in Japanese Patent Application Laid-open No. 64-47831 and 3-10041, respectively. The alloys described in these Japanese applications have been developed with the object of obtaining single-phase amorphous alloys.

It is generally known that some amorphous alloys are crystallized when being heated to a certain temperature (crystallization temperature) and become brittle. The present inventors have discovered that a high strength material can be obtained from a specific alloy whose composition is so controlled that fine crystal grains comprising additive elements dissolved in a main alloying element to form a supersaturated solution are dispersed throughout an amorphous matrix and made Japanese Patent Application No. 2-59139 which was laid open to public inspection under Laid-Open No. 3-260037. The process described in this patent application is carried out by controlling the cooling rate in the preparation of the alloys by liquid quenching. The resulting alloy is not beyond alloy powders or thin ribbons ordinarily obtained.

SUMMARY OF THE INVENTION

The present inventors has found a process for effectively and stably producing amorphous bulk materials having high toughness and high strength and containing fine crystal grains consisting of a supersaturated solid solution therein. This invention has been reached on the basis of such a finding.

The present invention provides a process for producing amorphous alloy materials having high toughness and high strength from various amorphous alloy powders, thin-ribbons or bulk materials by heating them to a temperature which does not cause the formation of intermetallic compounds or other compounds, but cause the precipitation of supersaturated solid solution crystal grains. By this heating, fine crystal grains, which consist of a supersaturated solid solution made of a main alloying element and additive elements and have a mean diameter of 5 nm to 500 nm, are precipitated and uniformly dispersed in a volume percentage of 5 to 50% in an amorphous matrix.

In the process of the present invention, when deformation, pressing or other working is simultaneously conducted with the heating, consolidation or combining of the resultant alloy materials can also be effected in the same production procedure.

The amorphous alloys used in the production process are preferably composed of Al, Mg or Ti as a main element and, as additive elements, rare earth elements, including Y and Mm (misch metal) consisting of a mixture of rare earth elements, and/or other elements. In the preferred embodiments, the Al-based amorphous alloy, Mg-based amorphous alloy and Ti-based amorphous alloy are heated at temperatures ranging from 373 to 573 K, 353 to 573 K and 573 to 1073K , respectively, and in these temperature ranges, fine crystal grains consisting of a supersaturated solid solution are uniformly precipitate in their amorphous matrix without causing the formation of intermetallic compounds or other compounds.

DETAILED DESCRIPTION OF THE PREFERRED EMBODIMENTS

Figure 1:
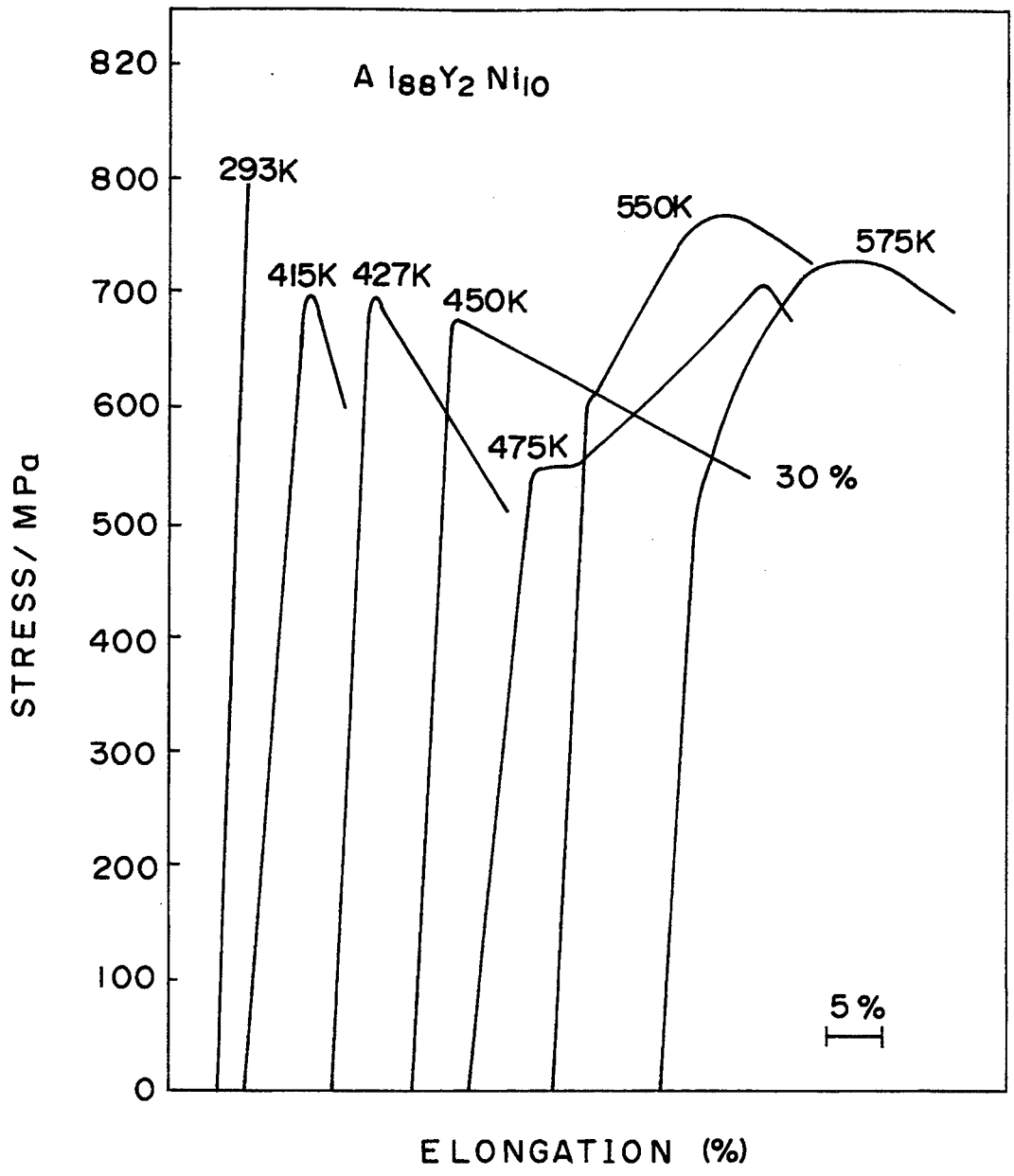
FIG. 1 is stress-strain curves diagrammatically showing the results of tensile tests for the materials obtained in an example.

When well-known amorphous alloys are crystallized by heating, intermetallic compounds and other compounds unavoidably precipitate out since the proportion of additive elements to the main alloying element is relatively high. Therefore, the resulting alloy material becomes considerably more brittle.

In single-phase amorphous alloys prepared by reducing the amount of additive elements in order to prevent the problem of embrittlement, the above-mentioned precipitation of intermetallic compounds and other compounds, which occurs during crystallization by heating, can be suppressed and only fine crystal grains including additive elements dissolved in crystals of the main element so as to form a supersaturated solid solution can be precipitated. When the main element is aluminum, the crystals has a face-centered cubic structure. In case of using magnesium or titanium as the main element, the crystal has a hexagonal close-packed structure. The thus precipitated crystal grains have a mean diameter ranging from several nanometers to several hundreds of nanometers and they are uniformly dispersed throughout the amorphous matrix. In such a multiphase state, the material is not embrittled and exhibits a better ductility than in an amorphous single-phase state. Therefore, the material can be bent to 180° even at room temperature or even in a thin ribbon form of 20 to 50 μm in thickness.

The important feature for an amorphous alloy having a properly controlled composition is that it must have a plastic elongation of at least 20% at an appropriate working temperature for the precipitation of crystalline phases regardless of the type of the alloy. If such behavior can be effectively used, consolidation-forming, shaping or combining of amorphous alloy materials containing a crystalline phase becomes possible using various powdered or thin-ribbon like amorphous alloys or amorphous alloy bulk materials obtained, for example, by casting, as starting materials. This is a principal subject contemplated by this invention.

Alternatively, an amorphous alloy having a controlled composition as mentioned above can also be formed into a multiphase material consisting of an amorphous phase and a supersaturated solid solution phase by choosing an appropriate cooling rate in a rapid quenching process. However, the plastic elongation of the thus obtained material is less than 20% under the above-mentioned conditions. It can be construed from this fact that elongation observed in the crystallization process of a single-phase amorphous alloy is not simply due to the viscous flow of the amorphous phase, but due to the plastic flow (deformation) dynamically related to the precipitation of crystal grains.

With an increase in the volume percentage of crystal grains dispersed in the amorphous matrix, the strength of the material tends to increase. However, when the volume percentage of the supersaturated solid solution crystal grains contained in the amorphous matrix exceeds 50%, the material is considerably more brittle and cannot be used in practical applications. When the volume percentage is less than 5%, the elongation is the same level as that of an amorphous single phase and no any substantial improvement is revealed. Under such consideration, the volume percentage of the crystal grains is limited to the range of 5 to 50% in the present invention. When the strength and elongation are considered important, the optimum volume percentage of the fine crystal grains is from 15 to 35%. In general, the mixed phase structure of an amorphous phase and fine crystal grains can provide an improvement of 30 to 60% in strength as compared with an amorphous single-phase structure.

In the amorphous alloy material of the present invention, the mean diameter of the fine crystal grains dispersed therein is limited within the range of 5 nm to 500 nm in order to achieve the desired high toughness and high strength.

In general, the above properties are not limited only to specific alloy systems but may also be applied to any alloy system that can form an amorphous phase.

The following amorphous alloys can be preferably used for the preparation of the amorphous alloy materials of the present invention and they may be in the form of powder, thin ribbon and bulk.

Al-based amorphous alloy consisting of Al as a main element and rare earth elements and/or other elements, as additive elements. For example, there may be mentioned an Al-based amorphous alloy consisting of, in atomic percentages, 85 to 99.8% Al as the main element, 0.1 to 5% of at least one element selected from the group consisting of rare earth elements including Y and Mm as primary additive elements of the additive elements and up to 10% of at least one element selected from the group consisting of Ni, Fe, Co and Cu as secondary additive elements of the additive elements, with the proviso that the total content of the rare earth elements including Y and Mm is not more than the total content of the other additive elements. In the Al-based amorphous alloy, Al as the main element may be partially replaced in the range of 0.2 to 3 atomic % with at least one element selected from the group consisting of Ti, Mn, Mo, Cr, Zr, V, Nb and Ta.

Mg-based amorphous alloys consisting of Mg as a main element and rare earth elements and/or other elements as additive elements. For example, there may be mentioned an Mg-based amorphous alloy consisting of, in atomic percentages, 80 to 91% Mg as the main element, 8 to 15% of at least one element selected from the group consisting of Cu, Ni, Sn and Zn as primary additive elements of the additive elements and 1 to 5% of at least one element selected from the group consisting of Al, Si and Ca as secondary elements of the additive elements; and a Mg-based amorphous alloy consisting of, in atomic percentages, 80 to 91% Mg as the main element, 8 to 15% of at least one element selected from the group consisting of Cu, Ni, Sn and Zn as primary additive elements of the additive elements and 1 to 5% of at least one element selected from the group consisting of rare earth elements including Y and Mm as secondary additive elements of the additive elements. Mg as the main element of the Mg-based amorphous alloy may be partially substituted in the range of 1 to 5 atomic % by at least one element selected from the group consisting of Al, Si and Ca, when these elements are not present as the additive elements.

Ti-based amorphous alloy consisting of Ti as a main element and rare earth elements, including Y and M (misch metal) consisting of a mixture of rare earth elements, and/or Fe and Si as additive elements.

Hereinafter, the present invention will be specifically described with reference to the Examples.

EXAMPLE 1

A mother alloy having a composition of $Al_{88}Y_2Ni_{10}$ (atomic %) was prepared in an arc melting furnace. An amorphous thin ribbon (thickness: 30 μm, width: 1.5 mm) consisting of an amorphous single phase was prepared from the above alloy, using an ordinary single-roll liquid quenching apparatus. Whether the resultant thin ribbon was amorphous or not was examined by checking the presence of the characteristic halo pattern of an amorphous structure using an X-ray diffraction apparatus. It was confirmed that the thin ribbon was amorphous.

Figure 2:
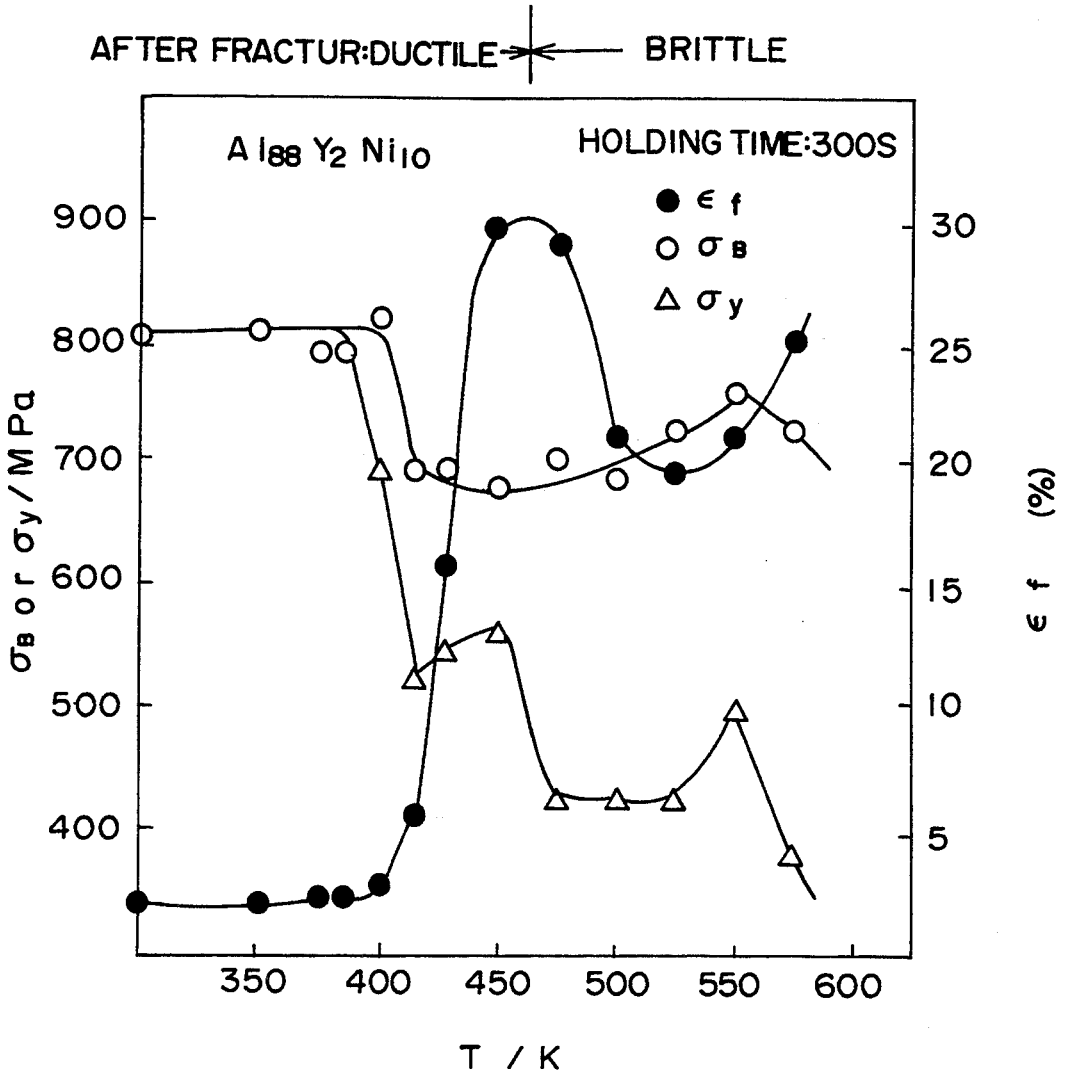
FIG. 2 is a graph summarizing the results shown in FIG. 1.

Tensile tests were carried out on the thin ribbon at various temperatures. At each temperature, the holding time before measuring the tensile strength was 300 seconds. Stress-strain curves showing the test results are shown in FIG. 1 and the test results are summarized in FIG. 2. As shown in FIG. 2, the tensile strength ($\sigma_B$) was a constant strength of 800 MPa at temperatures of not higher than 400K (containing room temperature). At temperatures exceeding 400K, the tensile strength abruptly dropped to about 700 MPa, then remained almost constant up 500K, and gradually increased. The elongation ($\epsilon_f$) at temperatures up to 400K was a low value of about 2%. However, at temperatures exceeding 400K, the elongation sharply increased and reached 30% at 450K and decreased to 20% at 500K. Further, after reaching a temperature of 550K, the elongation again increased. On the other hand, no substantial increase was measured in the yield strength ($\sigma_y$) at a temperature lower than 400K (not greater than 0.2%). The ductility was examined by a bending test after standing each test sample, which had been subjected to the above tests, at room temperature. When the test sample could be bond-bent to 180° without cracking or other fracturing, it was judged as "ductile". When the test sample was subjected to cracking or fracturing, it was judged as "brittle". The test samples subjected to the tensile tests at temperatures not higher than 450K exhibited ductility and the samples tested at temperatures of 475K or higher showed embrittlement.

Further, the test samples after the tensile tests were observed by a transmission electron microscope (TEM). The TEM observation revealed that, in the sample after the tensile test at temperature of 450K, crystal grains of supersaturated solid solution having a face-centered cubic structure (fcc-Al) and having a diameter of 5 to 20 nm were uniformly dispersed in an amorphous matrix and the volume percentages of the crystal grains was about 30%. It was observed that the crystal grains dispersed in the samples tested at 500K had almost the same diameter but their volume percentage was 60%.

It can be seen from the above test results that crystallization induced by heating at a temperature of 400 to 450K provides an elongation sufficient for consolidation-forming or shaping and the material has ductility after the above working. Therefore, it is clear that the production process of the present invention is very useful as a process for producing amorphous alloy materials having high toughness and high strength.

EXAMPLE 2

An amorphous thin ribbon having a composition of $Al_{88}Ce_2Ni_9Fe_1$ (atomic %) was prepared in the same manner as set forth in Example 1 and the same tests as set forth in Example 1 were conducted.

The test results showed that fine crystal grains having a face-centered cubic structure (fcc-Al) precipitated at 455K. The precipitated crystal grains consisted of a supersaturated solid solution and were uniformly dispersed with a mean diameter of 5 to 20 nm in a volume percentage of 20% throughout an amorphous matrix. At a deformation temperature of 455K, the thin ribbon showed a plastic elongation of 40%. Further, after standing this tested sample at room temperature, it was subjected to a 180° bond-bending test. As a result, the sample was found to be ductile.

EXAMPLE 3

An amorphous thin ribbon having a composition of $Al_{88}Mm_2Ni_9Mn_1$ (atomic %) was prepared in the same manner as set forth in Example 1 and the same tests as set forth in Example 1 were conducted.

The test results showed that fine crystal grains having a face-centered cubic structure (fcc-Al) precipitated at 450K. The precipitated crystal grains consisted of a supersaturated solid solution and were uniformly dispersed with a mean diameter of 5 to 20 nm in a volume percentage of 20% throughout an amorphous matrix. When the thin ribbon was subjected to deformation at 450K, it showed a plastic elongation of 38%. Further, after standing the tested sample at room temperature, it was subjected to a 180° bond-bending test. As a result, the sample was found to be ductile.

EXAMPLE 4

An amorphous thin ribbon having a composition of $Mg_{85}Zn_{12}Ce_3$ (atomic %) was prepared in the same manner as set forth in Example 1 and the same tests as set forth in Example 1 were conducted. The test results showed that fine crystal grains having a hexagonal close-packed structure (hcp-Mg) precipitated at 360K. The precipitated crystal grains consisted of a supersaturated solid solution and were uniformly dispersed with a mean diameter of 5 to 30 nm in a volume percentage of 25% throughout an amorphous matrix. When the thin ribbon was subjected to deformation at 360K, it showed a plastic elongation of 35%. Further, after standing the tested sample at room temperature, it was subjected to a 180° bond-bending test. As a result, the sample was found to be ductile.

EXAMPLE 5

An amorphous thin ribbon having a composition of $Ti_{87}Si_{10}Fe_3$ (atomic %) was prepared in the same manner as set forth in Example 1 and the same tests as set forth in Example 1 were conducted. The test results showed that $\beta$-Ti fine crystal grains precipitated at 650K. The precipitated crystal grains consisted of a supersaturated solid solution and were uniformly dispersed with a mean diameter of 5 to 15 nm in a volume percentage of 25% throughout an amorphous matrix. When the thin ribbon was subjected to deformation at this temperature, i.e., 650K, it showed a plastic elongation of 40%. Further, after standing the tested sample at room temperature, it was subjected to a 180° bond-bending test. As a result, the sample was found to be ductile.

In the above tensile tests at various temperatures, when the thin ribbons were heated to temperatures which caused precipitation of fine crystal grains consisting of a supersaturated solid solution but did not cause formation of intermetallic compounds or the like, the resulting fine crystal grains were uniformly dispersed within the ranges of volume percentages (5 to 50%) and mean diameters (5 to 500 nm) specified in the present invention in the amorphous matrix. Further, the heated thin ribbons exhibited high strength, good elongation and good ductility.

As set forth above, according to the production process of the present invention, amorphous alloy bulk materials containing fine crystal grains consisting of a supersaturated solid solution can be effectively and stably produced with high toughness and strength.

What is claimed is:

1. A process for producing an amorphous alloy material having high toughness and high strength, which comprises heating an amorphous alloy in the form of powder, thin ribbons or bulk shapes consisting of an amorphous phase up to a temperature at which intermetallic compounds or other compounds are not formed while subjecting the amorphous alloy being heated to deformation-forming, pressing or other working, and thereby causing precipitation and uniform dispersion of crystal grains consisting of a supersaturated solid solution made of a main element and additive elements and having a mean diameter of 5 nm to 500 nm in a volume percentage of 5 to 50% in an amorphous matrix, and simultaneously effecting consolidation-forming or combining.

2. A process as claimed in claim 1 in which the amorphous alloy is a Ti-based amorphous alloy consisting of Ti as a main element and rare earth elements, including Y and Mm (misch metal) consisting of a mixture of rare earth elements, and/or Fe and Si as additive elements.

3. A process as claimed in claim 1 in which the amorphous alloy is an Al-based amorphous alloy consisting of, in atomic percentages, 85 to 99.8% Al, 0.1 to 5% of at least one element selected from the group consisting of rare earth elements including Y and Mm (misch metal) consisting of a mixture of rare earth elements as primary additive elements of the additive elements and up to 10% of at least one element selected from the group consisting of Ni, Fe, Co and Cu as secondary additive elements of the additive elements, with the proviso that the total content of the rare earth elements including Y and Mm is not more than the total content of the other additive elements.

4. A process as claimed in claim 3 in which Al as the main element of the Al-based amorphous alloy is partially substituted in the range of 0.2 to 3 atomic % by at least one element selected from the group consisting of Ti, Mn, Mo, Cr, Zr, V, Nb and Ta.

5. A process as claimed in claim 1 in which the amorphous alloy is a Mg-based amorphous alloy consisting of, in atomic percentages, 80 to 91% Mg, 8 to 15% of at least one element selected from the group consisting of Cu, Ni, Sn and Zn as primary additive elements of the additive elements and 1 to 5% of at least one element selected from the group consisting of Al, Si and Ca as secondary additive elements of the additive elements.

6. A process as claimed in claim 1 in which the amorphous alloy is a Mg-based amorphous alloy consisting of, in atomic percentages, 80 to 91% Mg, 8 to 15% of at least one element selected from the group consisting of Cu, Ni, Sn and Zn as primary additive elements of the additive elements and 1 to 5% of at least one element selected from the group consisting of rare earth elements including Y and Mm (misch metal) consisting of a mixture of rare earth elements as secondary additive elements of the additive elements.

7. A process as claimed in claim 6 in which Mg as the main element of the Mg-based amorphous alloy is partially substituted in the range of 1 to 5 atomic % by at least one element selected from the group consisting of Al, Si and Ca.

8. A process as claimed in claim 2 in which the additive elements are Fe and Si.

9. A process as claimed in claim 2 in which said temperature ms in the range of 573°–1073° K.

10. A process as claimed in claim 3 in which said temperature is in the range of 373°–573° K.

* * * * *

UNITED STATES PATENT AND TRADEMARK OFFICE

CERTIFICATE OF CORRECTION

PATENT NO. : 5,350,468

DATED : September 27, 1994

INVENTOR(S) : Tsuyoshi MASUMOTO

It is certified that error appears in the above-indentified patent and that said Letters Patent is hereby corrected as shown below:

Column 6, line 36; replace "in" with ---and---.

Column 8, line 9; replace "ms" with ---is---.

Signed and Sealed this

Fourteenth Day of March, 1995

Bruce Lehman

*Attest:*

BRUCE LEHMAN

*Attesting Officer*

*Commissioner of Patents and Trademarks*